US008424972B2

(12) United States Patent
Berning et al.

(10) Patent No.: US 8,424,972 B2
(45) Date of Patent: Apr. 23, 2013

(54) ROAD MILLING MACHINE AND METHOD FOR POSITIONING THE MACHINE FRAME PARALLEL TO THE GROUND

(75) Inventors: Christian Berning, Zülpich (DE); Dieter Simons, Buchholz (DE)

(73) Assignee: Wirtgen GmbH (DE)

( * ) Notice: Subject to any disclaimer, the term of this patent is extended or adjusted under 35 U.S.C. 154(b) by 520 days.

(21) Appl. No.: 12/226,342

(22) PCT Filed: Dec. 21, 2007

(86) PCT No.: PCT/EP2007/064520
§ 371 (c)(1),
(2), (4) Date: Oct. 16, 2008

(87) PCT Pub. No.: WO2008/077963
PCT Pub. Date: Jul. 3, 2008

(65) Prior Publication Data

US 2009/0108663 A1 Apr. 30, 2009

(30) Foreign Application Priority Data

Dec. 22, 2006 (DE) ..... 20 2006 019 509 U

(51) Int. Cl.
*E01C 23/088* (2006.01)

(52) U.S. Cl.
USPC ..... 299/1.5; 299/39.6; 404/84.05

(58) Field of Classification Search ..... 299/1.5, 299/39.6; 404/84.05
See application file for complete search history.

(56) References Cited

U.S. PATENT DOCUMENTS 3,423,859 A 1/1969 Swisher, Jr. et al.
3,598,027 A 8/1971 Swisher, Jr.
3,946,506 A 3/1976 Snow, Jr. et al.

(Continued)

FOREIGN PATENT DOCUMENTS

EP 1 154 075 A2 11/2001

OTHER PUBLICATIONS

U.S. Appl. No. 12/003,094, filed Dec. 20, 2007, entitled "Road Milling Machine and Method for Measuring the Milling Depth", U.S. Patent Publication 2008/0152428 (not prior art).

*Primary Examiner* — John Kreck
(74) *Attorney, Agent, or Firm* — Waddey & Patterson, P.C.; Lucian Wayne Beavers

(57) ABSTRACT

In a self-propelled road milling machine (1), particularly a cold-milling machine, comprising a track assembly carrying the machine frame (4) via lifting columns (12,13), a milling roller (6) supported on the machine frame (4) for treatment of a ground surface (8) or traffic surface (8), height-adjustable side plates (10) for edge protection, arranged to rest on the ground surface (8) or traffic surface (8) to be treated, a height-adjustable stripping means (14) arranged in the moving direction behind the milling roller (6) and adapted to be lowered, during operation, into the milling track (17) generated by the milling roller (6), and a control means (23) for controlling the milling depth of the milling roller (6), the control means (23) detecting the milling depth of the milling roller (6) from the measurement values of at least one measuring means (16), it is provided that the control means (23) is operative to automatically control the lifting condition of at least one rear and/or front lifting column (12,13) as seen in the traveling direction, for establishing the parallel orientation of the machine frame (4) relative to the ground surface (8) or traffic surface (8) or to a predetermined milling plane.

40 Claims, 8 Drawing Sheets

U.S. PATENT DOCUMENTS 4,139,318 A * 2/1979 Jakob et al. ..... 404/90
4,325,580 A 4/1982 Swisher, Jr. et al.
4,943,119 A 7/1990 Zarniko et al.
5,309,407 A * 5/1994 Sehr et al. ..... 367/96
5,315,770 A 5/1994 Campbell
5,378,081 A 1/1995 Swisher, Jr.
5,607,205 A * 3/1997 Burdick et al. ..... 299/1.5
5,639,181 A 6/1997 Swisher, Jr.
5,893,677 A 4/1999 Haehn et al.
5,984,420 A * 11/1999 Murray et al. ..... 299/1.5
6,371,566 B1 4/2002 Haehn
2002/0047301 A1 * 4/2002 Davis ..... 299/1.5
2007/0286678 A1 * 12/2007 Berning et al. ..... 404/90
2008/0152428 A1 6/2008 Berning et al.

* cited by examiner

ROAD MILLING MACHINE AND METHOD FOR POSITIONING THE MACHINE FRAME PARALLEL TO THE GROUND

BACKGROUND OF THE INVENTION

The invention refers to a self-propelled road milling machine, especially a cold milling machine, as well as a method for positioning the machine frame parallel to the ground.

In such road milling machines, the machine frame is supported by a track assembly comprising wheels or caterpillar tracks connected to the machine frame through lifting columns, the lifting columns allowing to adjust the machine frame to a specific horizontal plane or in parallel to the ground or under a predetermined longitudinal and/or transversal inclination.

A milling roller for working a ground or traffic surface is supported at the machine frame.

Near the front end sides of the milling roller, height-adjustable side plates are provided as edge protectors at an outer wall of the road milling machine, which side plates, in operation, rest on the ground or traffic surface at the lateral non-milled edges of the milling track. Behind the milling roller, seen in the traveling direction, a height-adjustable stripping means is provided which, in operation, may be lowered into the milling track formed by the milling roller to strip off milling material remaining in the milling track. Further, the road milling machine has a control means for controlling the milling depth of the milling roller and for controlling the setting of the lifting columns.

It is a problem with known road milling machines that, if the machine frame does not extend parallel to the ground, the stripping means will not rest on the ground with sufficient exactness behind the milling roller to allow for a residue-free stripping process to be performed on the surface under treatment. Further, the problem exists that, if the machine frame is not arranged parallel to the ground, the band shoe surrounding the transport band does not flatly rest thereon, so that material which has been milled off may intrude into the region between the band shoe and the still untreated ground surface, or that the function as a hold-down means is performed insufficiently so that chunks of ground material will warp in front of the milling roller and become adhered under the band shoe. Further, the problem exists that the milling depth can not be controlled accurately enough and that, for this reason, the milling depth has to be measured repeatedly by hand during the milling operation. Especially in cases where a hard traffic surface, e.g. concrete, is milled, the tools are worn heavily so that the milling depth set is corrupted by the decreasing diameter of the cutting circle. For example, the wear of the tools, when milling concrete, can cause a difference in the milling radius of 15 mm after only a few 100 meters, so that the measuring of a displacement of side plates, for example, with respect to the machine frame is not sufficiently accurate. If the milling depth is insufficient, a time-consuming reworking of the milling track has to be carried out. Should the milling track be too deep, more building material has to be applied afterwards in order to achieve the desired ground or traffic surface level.

SUMMARY OF THE INVENTION

Thus, it is an object of the invention to simplify the operating of the road milling machine and to improve the milling process.

The invention advantageously provides that the control device automatically controls the lifting condition of at least one rear and/or front lifting column, as seen in the traveling direction, for positioning the machine frame parallel to the ground or traffic surface or for positioning the machine frame at a predetermined milling level.

The invention is useful also for recycling machines.

The solution according to the invention has the advantage that the parallel orientation of the machine frame relative to the ground or traffic surface is automatically set and that the operating person does not have to readjust this parallel arrangement on his or her own, particularly not after a likewise automatic control of the milling depth. By keeping the machine frame held parallel to the treated or untreated ground or traffic surface, the correct functioning of other machine elements, e.g. of the stripping means and of the band shoe, is guaranteed. This will prevent operational disturbances caused by material accumulating under the band shoe or chunks of material becoming warped up due to an inaccurate setting of the parallel orientation, or by the impossibility to correctly strip off the already milled surface.

Further, the operating person can concentrate on the actual driving process and is not distracted by control processes which have to be performed manually.

For establishing the parallel orientation of the machine frame relative to the bottom or traffic surface, the control device can detect the longitudinal inclination of the machine frame relative to the treated or untreated ground.

Detection of the longitudinal inclination can be performed on the basis of two distance values indicating the distance between the machine frame and the treated or untreated ground, said distance values being displaced relative to each other in the traveling direction.

The longitudinal inclination can be detected from at least a first distance value between the machine frame and the treated ground, and at least one second distance value, displaced relative to the first distance value in the traveling direction, between the machine frame and the untreated ground, in connection with a measurement value for the milling depth.

The first or the second distance value between the machine frame and the treated or untreated ground can be detectable from the position of a chain track assembly running on the treated or untreated ground, relative to the machine frame.

The longitudinal inclination can be detectable from a first distance value between the machine frame and the treated ground and a second distance value between the machine frame and the treated ground, with the second distance value being detectable from the position of the stripping means or from the position of at least one of the track assemblies running on the treated ground, relative to the machine frame.

A transport band can be arranged on the machine frame, with a band shoe taking up the roll-side end of the transport band provided for discharge of the milled material.

The longitudinal inclination can be detectable from at least one first distance value between the machine frame and the untreated ground and a second distance value between the machine frame and the untreated ground, the second distance value being detectable from the position of the band shoe or from the position of at least one of the chain track assemblies running on the untreated ground or from the position of at least one of the side plates.

The distance values between the machine frame and the treated or untreated ground can be detectable with the aid of path measurement systems.

The path measurement systems can be integrated in the lifting columns or in the hydraulic cylinders of the lifting columns.

The longitudinal inclination of the machine frame relative to the untreated ground can be detectable from the relative angle, as seen in the traveling direction, between a side plate resting on the ground and the machine frame.

The longitudinal inclination of the machine frame relative to the treated or untreated ground can be detectable from the relative angle between at least one lifting column extending orthogonally to the machine frame and the track assembly extending parallel to the ground.

The automatic establishing of the parallel orientation of the machine frame relative to the treated or untreated ground can be performed by the control means only when the control means performs a readjustment of the milling depth or performs a setting of a predefinable milling depth.

The control means can decide whether the lifting condition of the front and/or the rear lifting columns will be controlled for adaptation to the milling depth.

The automatic establishing of the parallel orientation of the machine frame relative to the treated or untreated ground can be performed by the control means independently of the control of the milling depth.

The control means can control the milling depth of the milling roller independently on each of both sides of the machine frame as seen in the traveling direction.

At least one measuring means can detect the lifting of a first sensor means resting on the ground or traffic surface and/or the lowering of a second sensor means to the bottom of the milling track, the lifting or lowering being effected in correspondence with the present milling depth, wherein, from the measured values supplied by the at least one measuring means, the control means can determine the milling depth of the milling roller.

For establishing the parallel orientation of the machine frame relative to the ground or bottom surface or to the predetermined milling plane, the lifting condition of the rear and front lifting columns as seen in the traveling direction can be adapted to be changed to the effect that the machine frame is pivotable about the milling roller axis.

Since the controlling of the parallel orientation of the machine frame is performed in such a manner that the machine frame is pivoted about the milling roller axis, it is accomplished that the controlling of the parallel orientation will not influence the milling depth, i.e. the milling configuration.

A method for establishing the parallel orientation of the machine frame relative to the ground or traffic surface or to a predetermined milling plane, for use in road milling machines wherein a ground or traffic surface is milled by means of a milling roller, in that the road milling machine is lowered together with the milling roller so as to perform the milling in correspondence to a predetermined milling depth, can comprise the detecting of the longitudinal inclination of the machine frame relative to the treated or untreated ground by detection of measurement values, and the automatic controlling of the lifting condition of at least one rear and/or front lifting column as seen in the traveling direction, so as to establish the parallel orientation of the machine frame relative to the ground or traffic surface or to the predetermined milling plane in dependence on the longitudinal inclination of the machine frame.

There can be provided at least one measuring means which detects the lifting of a first sensor means resting on the ground or traffic surface and/or the lowering of a second sensor means to the bottom of the milling track, the lifting or lowering being effected in correspondence with the present milling depth. From the measured values supplied by the at least one measuring means, the control means can determine the milling depth at the level of the stripping means of the milling roller or the second sensor means.

Here, the measurement is effected preferably at the level of the stripping means arranged closely behind the milling roller, or immediately behind the stripping means, if a separate sensor means is provided.

The second sensor means can consist of the stripping means.

Using the stripping means as a sensor means is advantageous in that no measuring errors will be caused by some unevenness in the milling track. It is another advantage that the stripping means is protected against wear at its bottom edge.

As an alternative, the control means can use the measurement values of the at least one measuring means to determine the current milling depth of the milling roller at the level of the milling roller axis. Preferably, this is done by a calculation that may also take into account an inclined position of the machine frame.

The measuring means are preferably formed by path sensing means. In one embodiment, it is provided that the first sensor means is formed by at least one of the side plates arranged on either side at the front sides of the milling roller so as to be height-adjustable and pivotable with respect to the machine frame. The side plates rest on the ground or traffic surface or are pressed against these, so that a change of their position relative to the machine frame during operation allows for an exact detection of the milling depth, if a measurement of the change of the position of a second sensor means is performed additionally in the milling track relative to the machine frame.

The measuring means can comprise cable lines coupled to the first sensor means and/or the second sensor means, and cable-line sensors as path sensing means.

Also in side plates, advantage exists that their bottom edges are protected against wear.

Here, the measuring means may comprise cable lines coupled with the side plates and/or the stripping means, and associated cable-line sensors as the path sensors which measure the changes of the position of the side plates and the stripping means relative to the machine frame, or the relative displacement of at least one of the side plates in relation to the stripping means or the second sensor means.

Preferably, the cable lines coupled with the side plates and the stripping means are arranged transversely to the milling track in a substantially vertical plane extending approximately at the level of the stripping means.

Hereby, it can be avoided that a measurement error is caused by using different reference planes for the measurement at the side plates with respect to the measurement at the stripping plate.

To achieve this, it may be provided that a cable line is coupled on the one hand with the stripping means and, on the other hand, with at least one of the side plates via a guide roller, such that a cable-line sensor will immediately measure the milling depth, e.g. at the guide roller.

The measuring means can detect the displacement of the first sensor means relative to the second sensor means or the respective displacement of the first and second sensor means relative to the machine frame.

According to another alternative, it may be provided that the stripping means has a respective measuring means at the side edges facing the side plates, which measures the relative displacement of the stripping means with respect to the at least one adjacent side plate or the relative displacement of at least one side plate with respect to the stripping means.

According to another alternative embodiment, the stripping means may include at least one height-adjustable beam as the first sensing means, which is guided vertically and linearly in the stripping means and extends transversely to the traveling direction, said beam resting on the ground or traffic surface beside the milling track, the position of the beam relative to the stripping means, preferably with respect to height and/or inclination, being measurable by the measuring means.

Due to gravity, the side plates may rest on the edges of the ground or traffic surface beside the milling track milled by the milling machine, or they may alternatively be pressed on the edges by hydraulic means.

The stripping means may also be pressed on the surface of the milling track using hydraulic means.

The hydraulic means for pressing the side plates on the ground or traffic surface or for pressing the stripping means on the bottom of the milling track may comprise integrated path sensing systems.

For lifting or lowering the side plates and/or the stripping means, a plurality of—preferably two—respective piston/cylinder units with integrated position sensing systems may be provided, whose path sensing signals are used by the control means to calculate the current milling depth from the relative difference between the positions of the stripping means and the at least one first sensor means.

The control means that receives the path sensing signals from the measuring means is adapted to automatically control means the lifted condition of the rear lifting columns, seen in the traveling direction, to establish parallelism between the machine frame and the ground or traffic surface at a desired milling depth.

The side plates resting on the traffic surface so as to be pivotable with respect to the machine frame may comprise measuring means spaced apart in the traveling direction, the control means being capable to measure the longitudinal and/or the transversal inclination of the machine frame with respect to the ground or traffic surface on the basis of the difference between the measurement signals from the side plates and the stripping means.

The front and/or rear lifting columns may include a path sensing system to detect the lifted condition. The control means which receives the path sensing signals from the measuring means can control the condition of all lifting columns to the effect the machine frame has a predetermined inclination or a predetermined travel-distance-dependent transverse inclination across the traveling direction.

Preferably, the current set value for the milling depth of the milling roller is adjusted using the front lifting columns.

The current desired value of the milling depth of the milling roller can be adjustable by means of the front lifting columns.

The control means which receives the measurement signals of all measurement means, of the side plates and/or of the stripping means and/or of the band shoe and/or of all lifting columns, is configured to detect, in dependence on the path measurement signals of the measuring means and/or of the desired site-dependent change of a desired value of the milling depth in the course of the treated path, the resultant lifting position of the lifting columns.

The zero level of the measurement means (16) can be set to the unmilled ground or traffic surface.

Each lifting column can have its lower end provided with a support for a wheel or a chain track assembly, and a distance sensor can measure the distance from said support to the bottom and traffic surface and transmit a measuring signal to a control means for the lifting position of the lifting column and/or to a control means for the milling depth of the milling roller.

The milling roller can extend substantially along the whole working width of the machine frame.

The milling roller can be supported in the machine frame in a height-adjustable manner.

The control means can compute the current milling depth from the obtained path measurement signals and generate a control signal for the height adjustment of the milling roller.

In a method for measuring the milling depth of road milling machines wherein a ground or traffic surface is milled with the aid of a milling roller by lowering the road milling machine together with the milling roller in correspondence to the predetermined milling depth, wherein a side plate on at least one side beside the milling track is set onto the untreated ground and traffic surface and wherein a stripping plate is lowered into the milling track generated by the milling roller, the measuring of the milling depth of the milling track can be performed by detecting the measurement values of at least one first sensor means detecting the position of the untreated ground or traffic surface, in relation to the measurement values of a second sensor means detecting the position of the bottom of the milling track, or by measuring the measurement values of both sensor means in relation to the machine frame.

In the method, the side edges to the side of the milling track can be kept down with the aid of side plates, and at least one of the side plates can be used as a first sensor means, while the stripping plate for stripping the milled surface is used as the second sensor means.

In the method, also the correcting of the measured milling depth value can be performed in dependence on the distance between the second sensor means and the axis of rotation of the milling roller if the machine frame of the road milling machine should not extend parallel to the ground or traffic surface.

The following is a detailed description of a preferred embodiment of the invention with reference to the accompanying drawings.

DETAILED DESCRIPTION OF THE PREFERRED EMBODIMENTS

Figure 1:
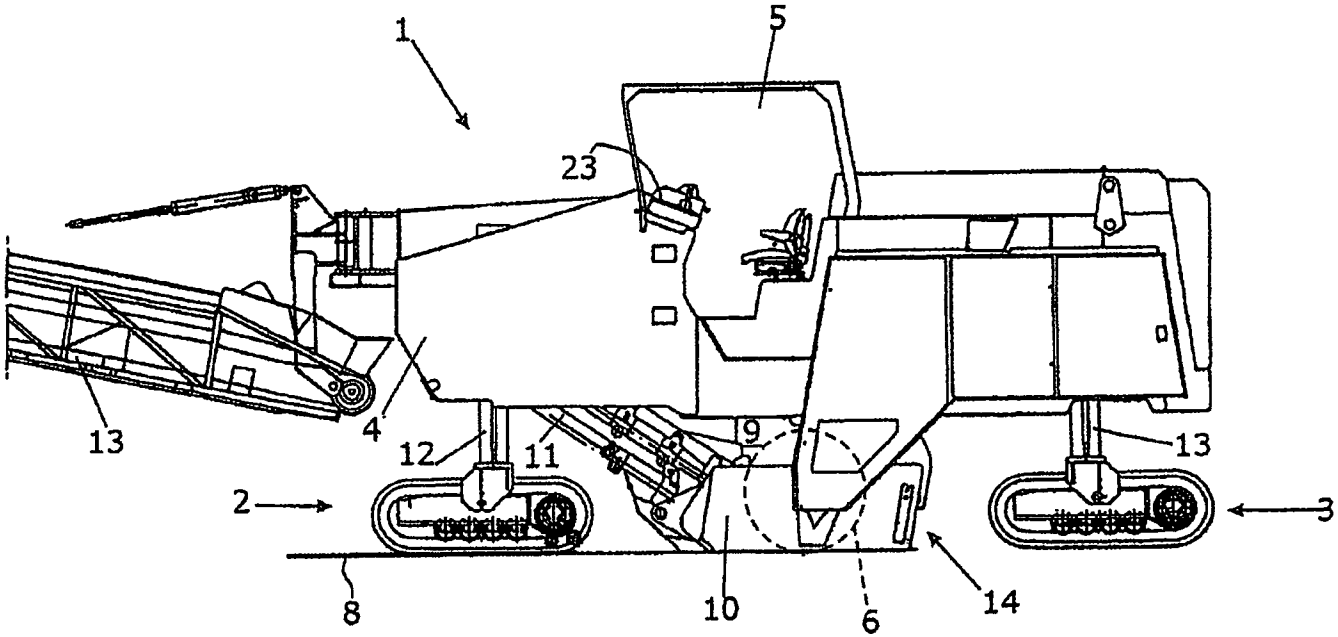
FIG. 1 shows a cold milling machine.

The road milling machine illustrated in FIG. 1 comprises a machine frame 4 supported by a track assembly having two front chain tracks 2 and at least one rear chain track 3. The chain tracks 2,3 are connected with the machine frame 4 via lifting columns 12,13. It is understood that wheels may be used instead of the chain tracks 2,3.

Using the lifting columns 12,13, the machine frame 4 can be lifted or lowered or be moved to take a predetermined inclined position with respect to the ground or traffic surface 8. The milling roller 6 supported in the machine frame 4 is enclosed by a roll case 9 which is open at the front, seen in the traveling direction, towards a conveyor belt 11 that conveys the milled material in a front part of the machine frame 4 to a second conveyor means 13. The second conveyor means 13 by which the milled material may be delivered onto a truck, for example, is not fully illustrated in FIG. 1 because of its length. Behind the milling roller 6, a height-adjustable stripping means 14 is arranged which, in operation, has a stripping plate 15 engage into the milling track 17 formed by the milling roller 6 and strip the bottom of the milling track 17 so that no milled material is left in the milling track 17 behind the stripping plate.

Above the milling roller 6, a driver's stand 5 with a control panel for the vehicle operator is provided for all control functions of the driving and milling operations. It also includes a control means 23 for controlling the milling depth of the milling roller 6.

The side plates 10, arranged on either side near the front end of the milling roller 6, and the stripping means 14 are provided with measuring means 16 that allow the determination of the current milling depth at the level of the stripping means 14 or the calculation of the milling depth at the level of the rotational axis of the milling roller. Here, the milling depth is determined in a plane orthogonal to the ground or traffic surface, which plane is parallel to the rotational axis of the milling roller and includes the rotational axis.

The position of a first sensor means, e.g. the side plates 10, on the ground or traffic surface 8, and/or the lowering of a second sensor means, e.g. the stripping means, can thus be detected. Measuring means 16, preferably formed by position sensing means, will measure the displacements of the sensor means, e.g. the side plates 10 or a beam 20 or the stripping plate 15, with respect to the machine frame 4 or relative to each other.

Figure 2:
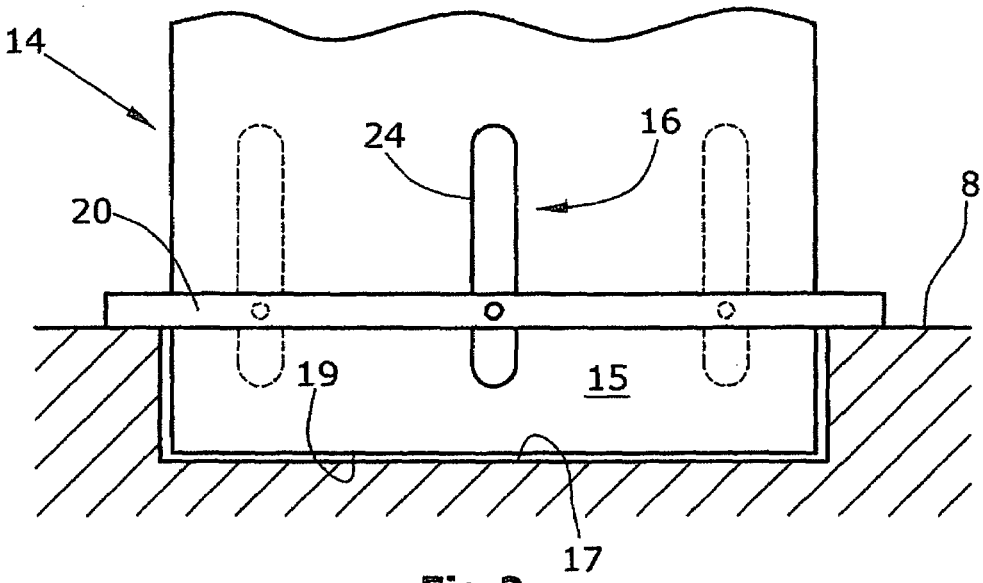
FIG. 2 illustrates a first sensor means attached to the stripping plate.

The embodiment illustrated in FIG. 2 shows a beam 20 as the sensor means, resting on the ground or traffic surface 8 and guided at the stripping plate 15 of the stripping means in a slot 24 extending linearly and orthogonally to the bottom edge 19 of the stripping plate 15. It is understood that two mutually parallel slots 24 can be provided in the stripping plate 15 or that the beam 20, serving as the sensing means, can be guided in a different manner so as to be height-adjustable at the stripping means 14. The measuring means 16, provided in the form of a position sensing means, detects the displacement of the beam 20 with respect to the stripping means 14. Should two horizontally spaced slots 24 be used, it is possible to separately detect the milling depth on the left side of the milling track 17 and on the right side of the milling track 17. Moreover, this offers the possibility to determine an inclination of the machine frame 4 with respect to the ground or traffic surface 8.

Figure 3:
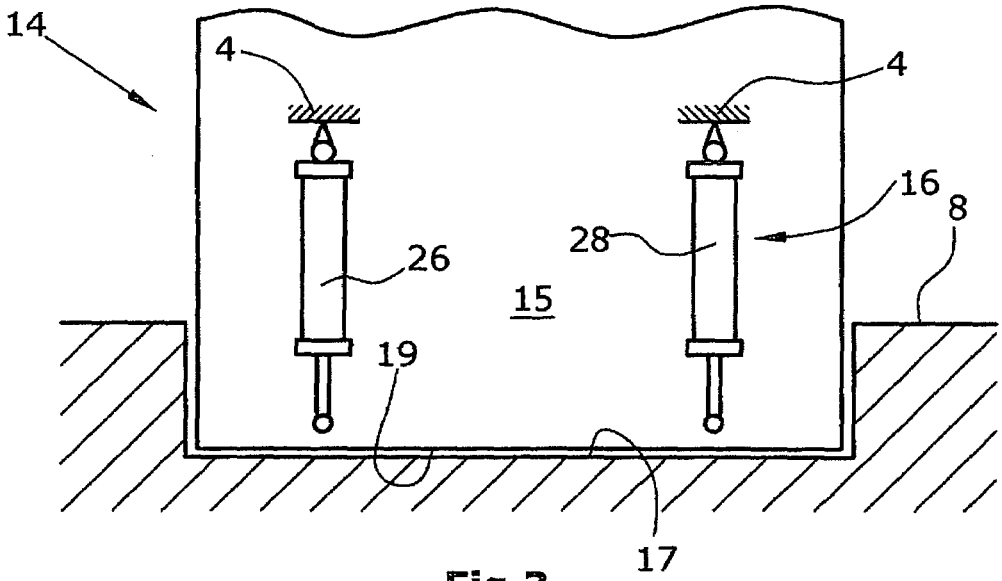
FIG. 3 shows two piston/cylinder units for lifting or lowering the stripping plate of a stripping means.

FIG. 3 illustrates another embodiment wherein the stripping plate 15 of the stripping means 14 can be lifted or lowered through hydraulic means. The hydraulic means are formed by piston/cylinder units 26,28 with an integrated position sensing system. This is to say that the piston/cylinder units 26,28 not only allow for the stroke movement of the stripping means, but moreover generate a position signal.

As is evident from FIG. 3, the piston/cylinder units 26,28 have one end connected to the machine frame 4 and the other end connected to the stripping plate 15.

Figure 4:
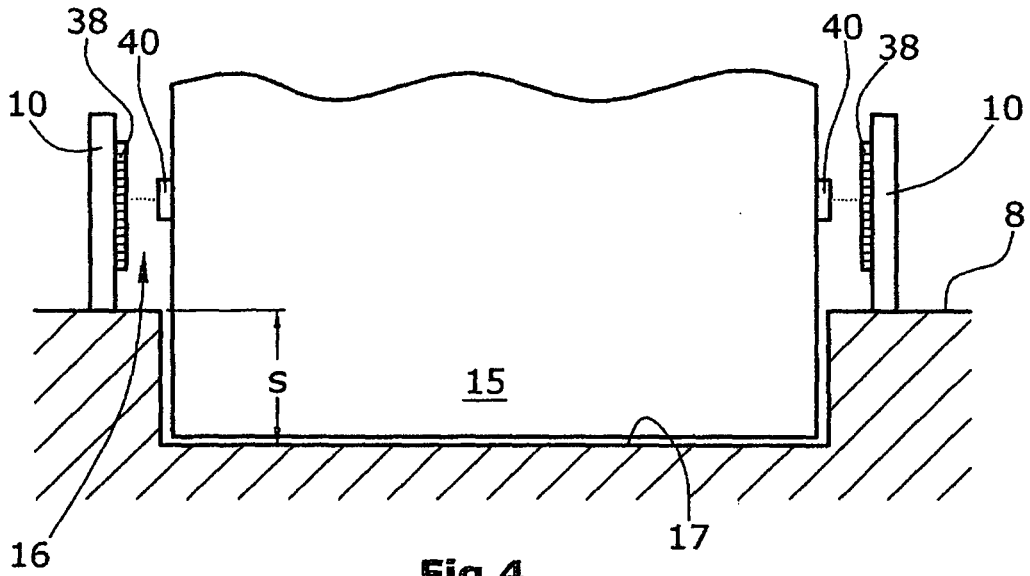
FIG. 4 illustrates an optical device for measuring the positional difference between the side plates and the stripping means.

FIG. 4 illustrates an embodiment wherein the relative movement between the side plates 10 and the stripping plate 15 is measured directly in order to detect the milling depth of the milling track 17. To achieve this, there are provided elements 38,40 of the measuring means 16, e.g. at the side plates 10 and opposite thereto at the stripping plate 15, which elements allow for the detection of the relative displacement of the stripping plate 15 with respect to the side plates 10. This displacement corresponds to the milling depth s in FIG. 4. For example, such a measuring means, which measures relative displacements, may be formed by an optical system, e.g. by reading a scale with an optical sensor, or by an electromagnetic or inductive system.

Figure 5:
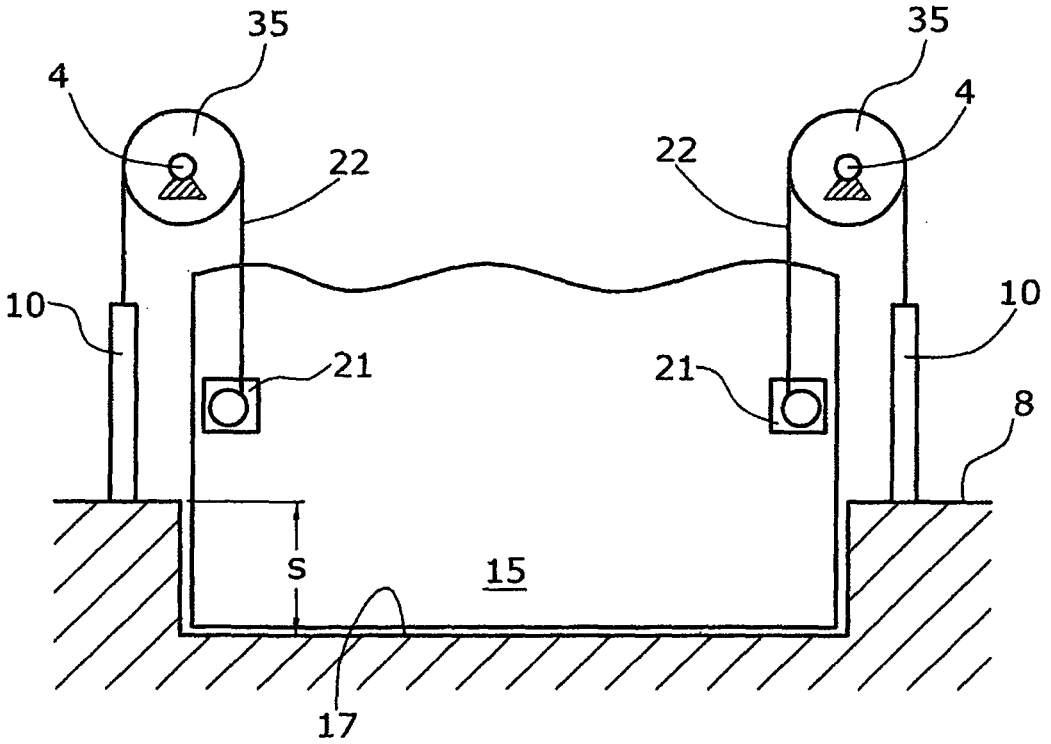
FIG. 5 shows a cable line measuring means provided between the side plates and the stripping means.

As an alternative and as illustrated in FIG. 5, the relative position sensing system between the side plates 10 and the stripping plate 15 may also be formed by a cable line 22 in combination with a cable-line sensor 21. The cable line 22 is coupled with the stripping plate 15 of the stripping means 14 on the one hand and, on the other hand, with at least one of the side plates 10 via a guide roller 35, so that the signal from the cable-line sensor 21 can immediately indicate the value of the current milling depth.

The side plates 10 themselves can be used as first sensor means by monitoring their position with respect to the machine frame 4 or the second sensor means by means of a cable line and a cable-line sensor or by means of piston/cylinder units 30,32 with integrated position sensing means.

For example, the measuring means can also measure the displacement of the side plates 10 with respect to the machine frame 4. Should two measuring means be used, one in front of the side plates 10 and one behind the same, when seen in the traveling direction, it is also possible to determine the longitudinal inclination of the machine frame 4 with respect to the ground or traffic surface 8 or to also determine the transverse inclination of the machine frame 4 by a comparison of the measured values for both side plates 10 on both sides of the milling roller 6.

Figure 6:
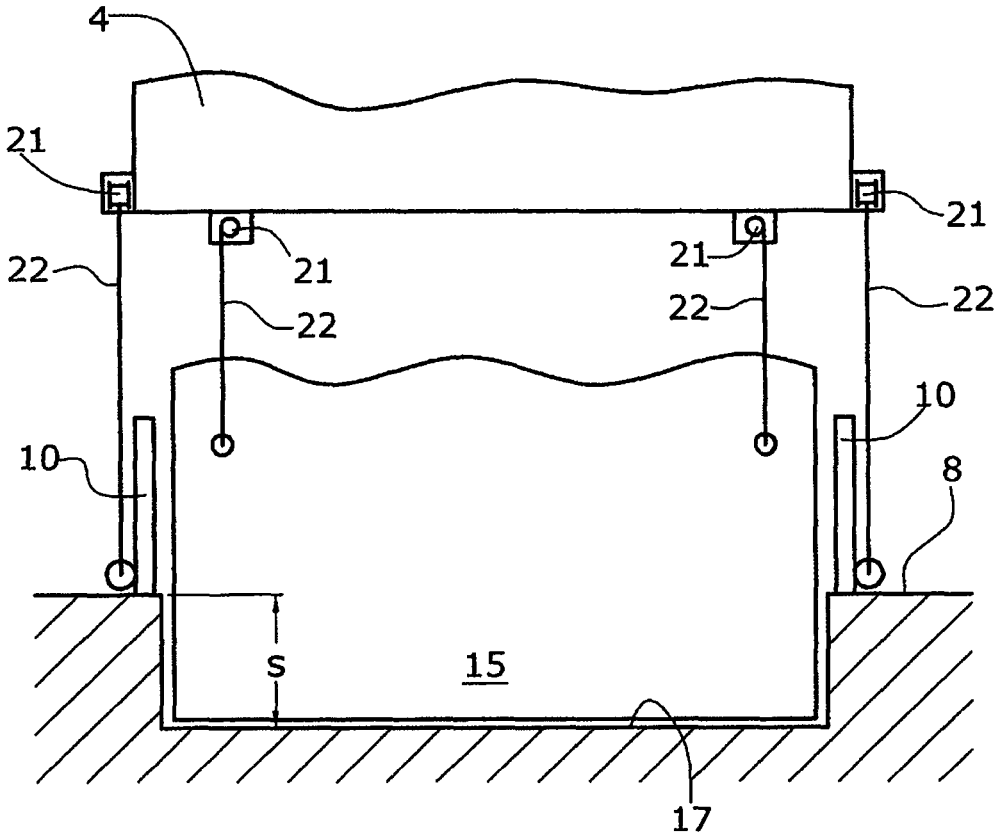
FIG. 6 illustrates a preferred embodiment.

FIG. 6 illustrates a preferred embodiment wherein cable lines 22 comprising cable-line sensors 21 mounted to the machine frame 4 are arranged on both sides of the stripping means 15. On either side of the machine, the side plates 10 are also provided with cable lines 22 and cable-line sensors 21 fastened at the machine frame 4. The milling depth is determined from the difference between the measured values of the cable-line sensors 21 for the side plates 10 and the cable-line sensors 21 of the stripping means 15. Here, the measurement should preferably made in the same substantially vertical plane in order to avoid measurement errors.

Figure 7A:
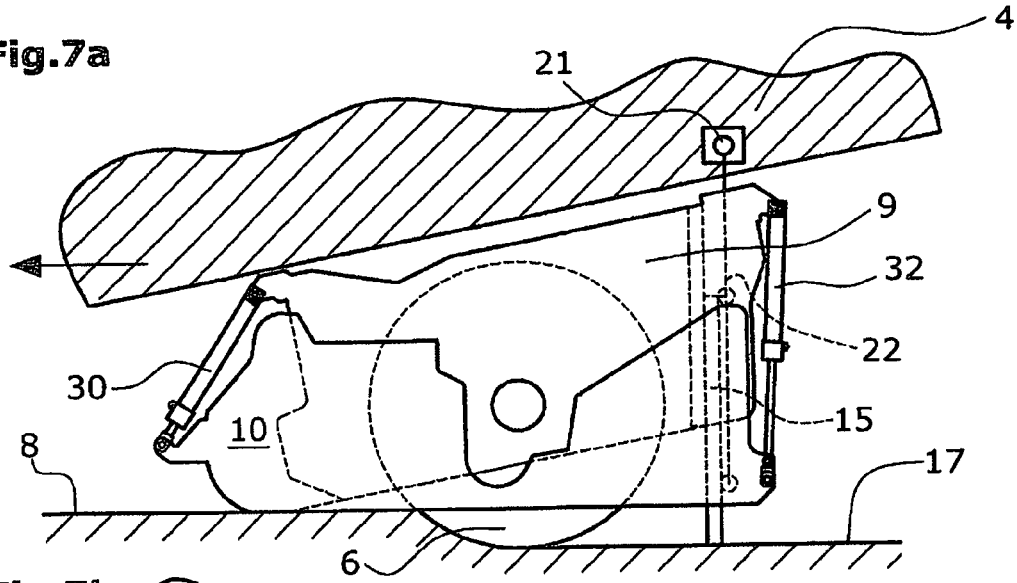
FIGS. 7*a, b, c* are schematic illustrations of the measurement error occurring at the stripping plate of the stripping means in the absence of parallelism between the machine frame and the ground or traffic surface.
Figure 7B:
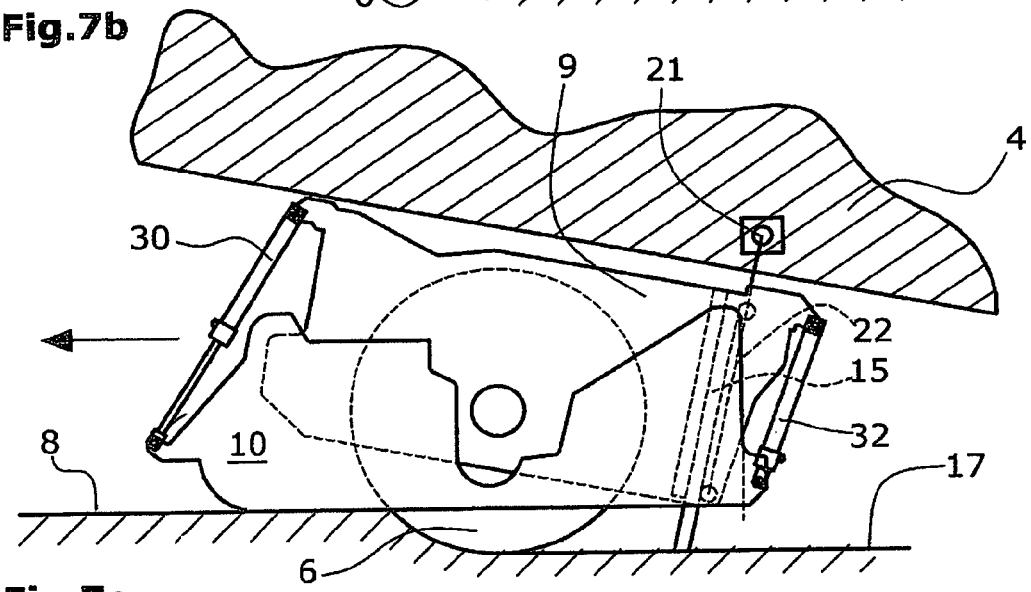
Figure 7C:
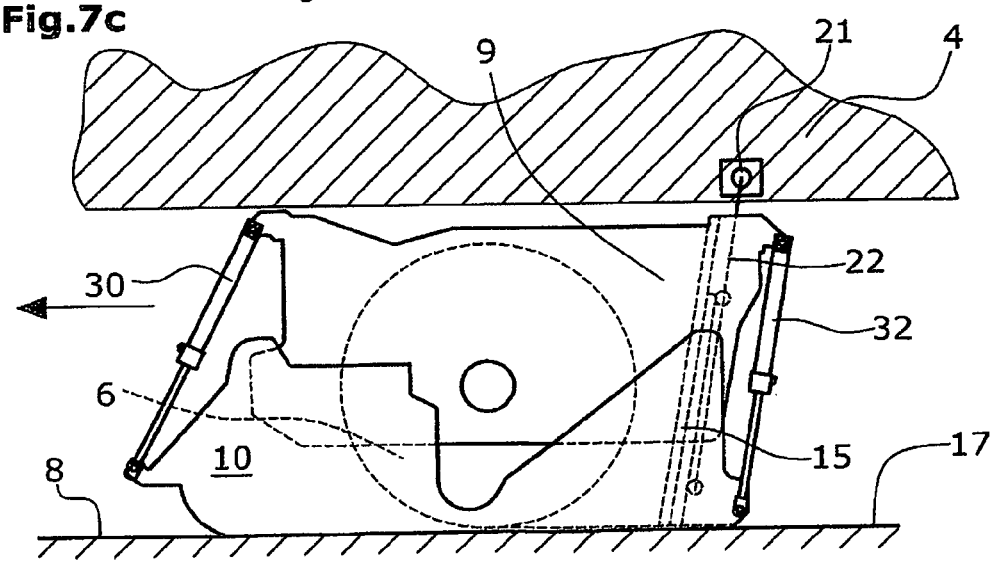

FIGS. 7*a* to 7*c* illustrate the cable-line sensors 21 for the side plates 10 and the stripping plates 14, the drawings only indicating one cable-line sensor 21, since the cable-line sensors are arranged one behind the other in substantially the same plane.

FIGS. 7*a, b, c* are to illustrate the case where the ground or traffic surface 8 is not parallel to the machine frame 4, the measured milling depth value indicated by the measuring means having to be corrected because of an angle error, because a longitudinal inclination of the machine frame 4 corrupts the measurement signal at the level of the stripping plate 15 or a second sensor means near the stripping means 14. Due to the fixed geometrical relations, i.e. the distance of the stripping plate 15 from the rotational axis of the milling roller 6, the measured milling depth value can be corrected, knowing the angular deviation from the horizontal in the traveling direction, and the current milling depth at the level of the milling roller axis can be calculated. The angular deviation in the traveling direction may be determined, for example, from the position of the lifting columns 12,13 of the caterpillar track assemblies 2,3 or the piston/cylinder units 30,32.

It is further evident from FIGS. 7*a* to *c* to which extent the side plates 10 are pivotable with respect to the machine frame 4. Since the piston/cylinder units 30,32 are also provided with position sensing systems, these measuring signals may be used as an alternative to cable-line sensors 21 to determine the distance of the side plates 10 from the machine frame 4.

FIG. 7*c* illustrates the position of the at least one side plate 10 for a ground-parallel position of the machine frame 4. The stripping plate 15 illustrated in FIGS. 7*a* to 7*c* is located at the roll case 9, so that the distance of the stripping plate 14 from the rotational axis to the milling roller 6 can be determined unambiguously in order to allow for a calculation of the milling depth correction in case that the machine frame 4 should not be parallel to the ground.

The control means 23 can calculate the current milling depth at the level of the milling roller axis from the position sensing signals received, and it can possibly also generate a control signal for a vertical adjustment of the milling roller 6.

Preferably, the control means 23 can automatically control the lifted condition of the front and/or rear lifting column 13, seen in the traveling direction, to establish parallelism between the machine frame 4 and the ground or traffic surface 8 or to the horizontal plane or to a predetermined desired milling plane.

For this purpose, all of the above described measuring means can be used also for detection of the angular orientation or longitudinal inclination in order to control the parallelism of machine frame 4 relative to the ground surface.

Figure 8:
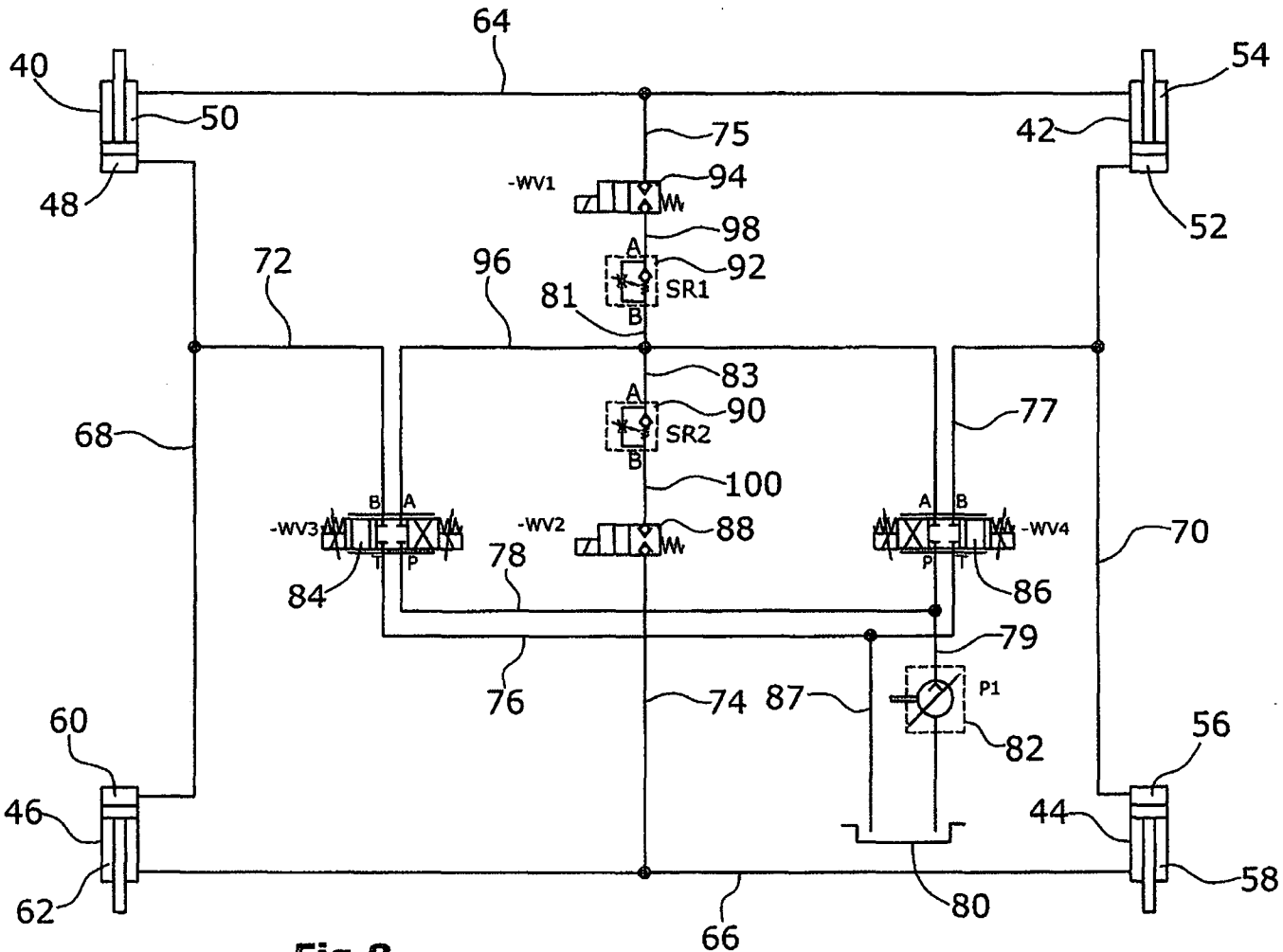
FIG. 8 shows hydraulic circuit diagram of a preferred embodiment.

FIG. 8 shows a schematic representation of a hydraulic circuit diagram of a road building machine 1. Assigned to the four lifting columns 12,13 are respective actuators allowing for height adjustment of the respective lifting column 12,13. The actuators are formed as working cylinders 40,42,44,46 in the lifting columns. Each working cylinder 40,42,44,46 comprises a first working chamber 48,52,56,60 and a second working chamber 50,54,58,62. The respective first working chamber 48,52,56,60 is separated from the respective second working chamber 50,54,58,62 by a respective piston. An increase of volume of the respective first working chamber 48,52,56,60 and a simultaneous reduction of volume of the respective second working chamber 50,54,58,62 will result in the extending of the respective lifting column 11,12 and an associated lowering of the respective track assembly.

The first working cylinder 40 is the actuator for the lifting column on the left front, the second working cylinder 42 is the actuator for the lifting column on the right-hand front, the third working cylinder 44 is the actuator for the lifting column on the right-hand rear, and the fourth working cylinder 46 is the actuator for the lifting column on the left rear.

The first working chamber 48 of the first working cylinder 40 is connected to the first working chamber 60 of the fourth working cylinder 46 via a connection line 68. The second working chamber 50 of the first working cylinder 40 is connected to the second working chamber 54 of the second working cylinder 42 via a connection line 64. The first working chamber 52 of the second working cylinder 42 is connected to the first working chamber 56 of the third working cylinder 44 via a connection line 70. The second working chamber 58 of the third working cylinder 44 in turn is connected to the second working chamber of the fourth working cylinder 46 via a connection line 66. Thus, the working chambers 40,42,44,46 are arranged to form a closed system via the connection lines 64,66,68,70, thus improving the road comfort and the stability of road building machine 1.

The connection line 68 is connected, via a further connection line 72, to a connector B of a first 4/3-way valve 84. A 4/3-way valve comprises four connectors and three switch positions. A second connector T of the first 4/3-way valve 84 is connected, via a connection line 76, to a connector T of a second 4/3-way valve 86. Connection line 76 is connected, via a working line 87, to a pressure medium sink 80. A third connector P of the first 4/3-way valve is connected, via a connection line 78, to a second connector P of the second 4/3-way valve 86. Further, a working line 79 is connected to connection line 78, with an oil pump provided in working line 79. On its other end, working line 79 likewise opens into the pressure medium sink 80.

A third connector B of the second 4/3-way valve 86 is connected, via a connection line 77, to connection line 70. A fourth connector A of the first 4/3-way valve 84 is connected, via connection line 96, to a fourth connector A of the second 4/3-way valve 86.

Further, connection line 64 is connected, via connection line 75, to a connector of a 2/2-way valve 94 (two connectors, two switching positions). The second connector of the first 2/2-way valve 94 is connected, via connection line 98, to a connector as a back-check valve 92. The other connector of back-check valve 92 is connected, via connection line 81, to connection line 96. Back-check valve 92 is blocked against fluid flows from connection line 81 to connection line 98.

Connection line 96 is further connected, via connection line 83, to a connector of a further back-check valve 90. The other connector of back-check valve 90 is connected, via connection line 100, to a connector of a further 2/2-way valve 88. The other connector of 2/2-way valve 88 is connected, via connection line 74, to connection line 66. Back-check valve 90 is operative to block fluid flows from connection line 100 to connection line 83.

By setting the two 4/3 path valves, control means 23 will control the displacement of the working cylinders 40,42,44,46 and thus the extending and retracting of the lifting columns 12,13. By the extending and retracting of the lifting column cylinders 12,13, the milling depth is adjusted. According to one embodiment, the milling depth of the milling roller is controlled independently on both sides of machine frame 4 when viewed in the traveling direction, because it is possible to displace only the left working cylinders 40,46 or the right working cylinders 42,44.

In the preferred embodiment according to FIG. 8, the control means 23 controls the parallel orientation of machine frame 4 relative to the ground or traffic surface 8 only when the control means 23 performs a readjustment of the milling depth or a setting of a predetermined milling depth. By setting the two 2/2-way valves 94,88 in a corresponding manner, the control means 23 determines whether the front working cylinders 40,42 and thus the front lifting columns 12 or the rear working cylinders 44,46 and thus the rear lifting columns 13 will be displaced. Thus, the establishing of the parallel orientation of the machine frame 4 relative to the ground or traffic surface 8 is not controlled actively by the control means 23, but passively in that, in a currently performed readjustment of the milling depth or in the process of newly setting a desired value for the predetermined milling depth, it is decided whether the quantity of oil flowing via the two 4/3-way valves 84,86 for this purpose is to be guided into the front working cylinders 40,42 and thus into the front lifting columns 12, or into the rear working cylinders 44,46 and thus into the rear lifting columns 13. Alternatively, the quantity of oil can be guided simultaneously into the front as well as the rear working cylinders 40,42,44,46 whereby the front and the rear lifting columns 12,13 are adjusted.

Figure 9:
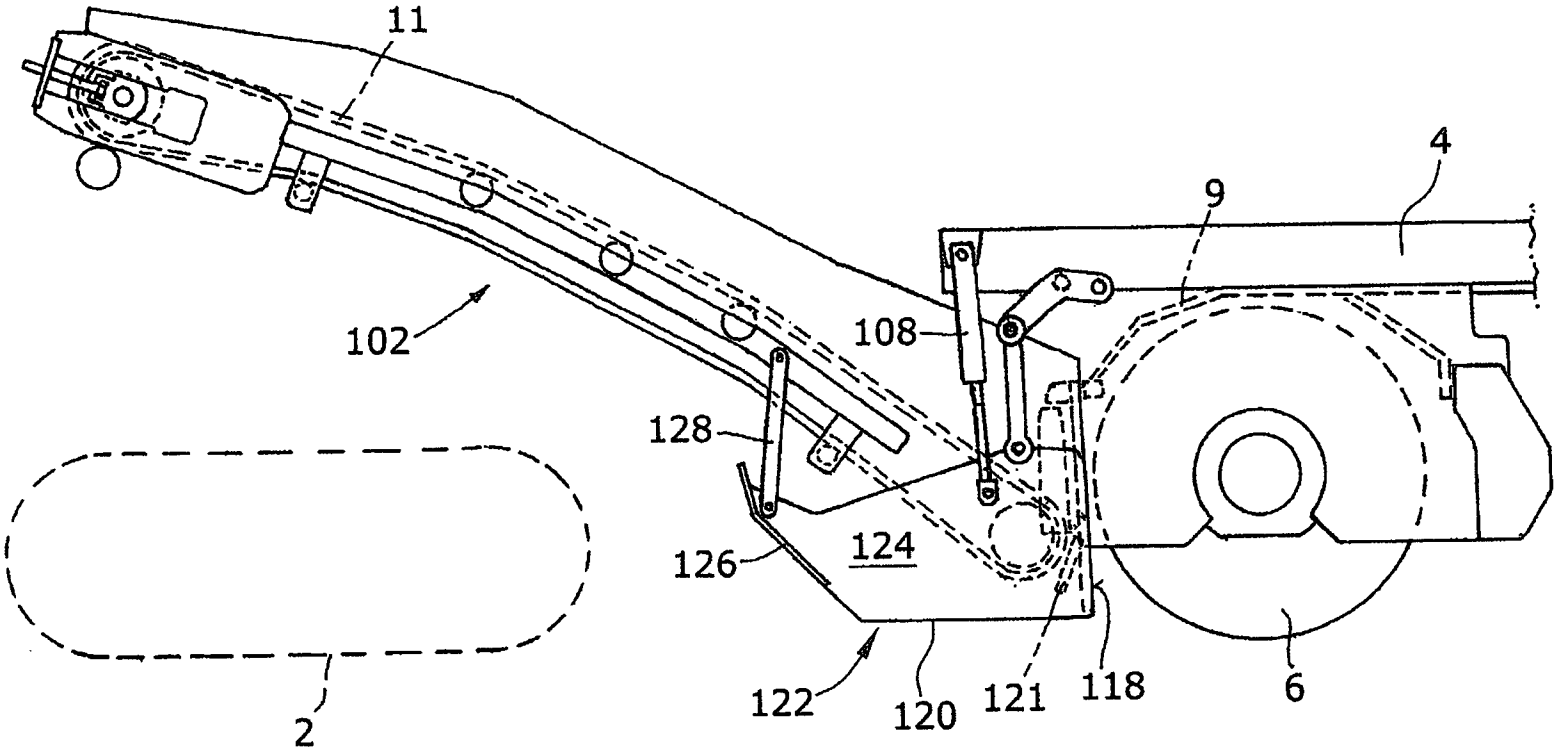
FIG. 9 shows an enlarged representation of the band shoe.

FIG. 9 shows the arrangement of a band shoe at a larger scale. Machine frame 4 has the band shoe 122 attached thereto in a manner allowing for height adjustment of the latter. For height adjustment of band shoe 122, there is provided a piston/cylinder unit 108 which is fastened to machine frame 4. With the aid of this piston/cylinder unit, the band shoe can be lifted in the vertical direction, e.g. for movement over obstacles. On its bottom, the bottom is in contact with the ground. When the milling depth is increased, the position of the band shoe 122 will be adjusted automatically by the ground contact.

Band shoe 122 receives the milling-roller-side end of the conveying means 102. The support of the rear end of conveying means 102 is a fixed point between band shoe 122 and conveying means 102. Provided on both sides of the front end of band shoe 122 are connection webs 128 preventing a pivoting movement of band shoe 122 relative to conveying means 102. Conveying means 102 preferably consists of a transport band 11.

Band shoe 12 consists of a grid 120 arranged parallel to the ground and serving a hold-down means and as a slide shoe. Grid 120 consists of a plurality of grid rods oriented parallel to the traveling direction. On the sides, grid 120 is delimited by vertical side walls 124. On the rear end of band shoe 122, a front region 126 is arranged substantially parallel to the transport band 11 of conveying means 102. Arranged on the rear end of the band shoe is a protective plate 121 for protection of the transport band 11, which plate is effective to prevent that the transport band 11 is damaged by sharp-edged material. A plate 118, slightly inclined in the traveling direction, has its upper region formed with a U-shaped recess for use as a passage opening for the milled-off material.

Path measurement systems, such as e.g. ultrasonic sensors or cable-line sensors, can be attached directly to the band shoe 122 or be integrated in the piston/cylinder unit 108. With the aid of the path measurement systems on the band shoe 122, the values of the distance between the machine frame 4 and the untreated ground can be detected.

Figure 10:
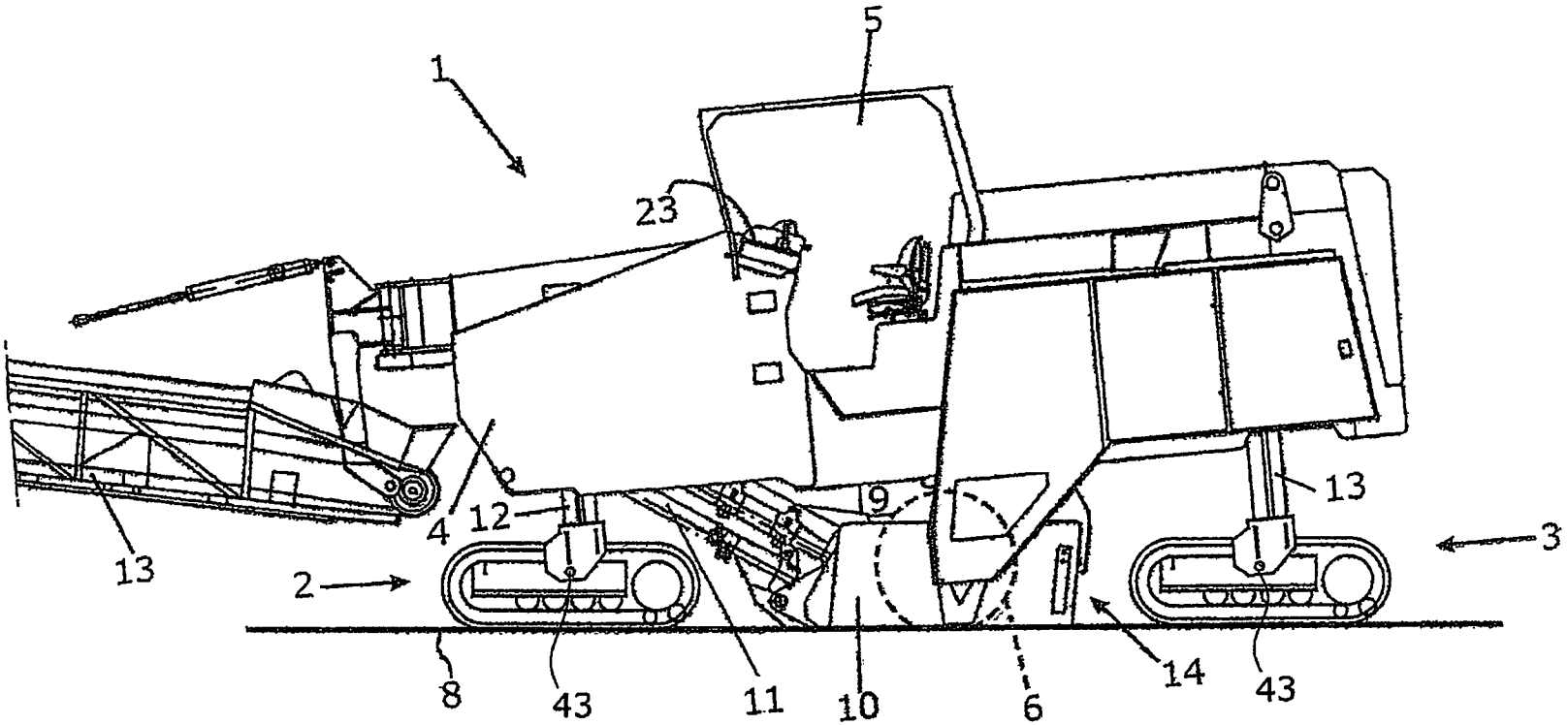
FIG. 10 shows a road milling machine in which the machine frame does not extend parallel to the ground surface.

In FIG. 10, there is illustrated a road milling machine 1 whose machine frame 4 is not oriented parallel to the ground surface 8. The lifting columns 12,13 have their lower ends supported in joints 43 on the respective chain track assemblies 2,3. For determining the longitudinal inclination of the machine frame relative to the ground surface 8, said joints 43 can be provided with angle-of-rotation sensors for detecting the relative angle between the lifting columns 12,13 extending orthogonally to machine frame 4, and the chain track assemblies 12,13 arranged in a parallel orientation on the ground surface. Alternatively, one of the side plates 10 can be provided with an angle-of-rotation sensor detecting the relative angle between the side plate 10 resting in a parallel orientation on the ground surface 8, and the machine frame 4.

According to a further embodiment, it can also be provided that two measuring means, arranged at a mutual distance in the longitudinal direction of the road milling machine, such as e.g. measuring means coupled to the piston/cylinder units 30,32, will detect the longitudinal inclination of machine frame 4.

What is claimed is:

1. A self-propelling road milling machine, comprising:

a machine frame;

at least two front ground engaging supports, and at least one rear ground engaging support, with reference to a direction of travel;

front and rear lifting columns supporting the frame from the ground engaging supports;

a milling roller supported from the frame for treatment of a ground surface;

first and second height adjustable side plates arranged on opposite sides of the milling roller;

a height adjustable stripping plate arranged behind the milling roller and operable to be lowered, during operation, into a milling track generated by the milling roller;

at least one ground engaging sensor; and a controller operably associated with the at least one ground engaging sensor, the controller being configured to automatically control a lifting condition of at least one of the lifting columns to establish a parallel orientation of the machine frame relative to the ground surface in the direction of travel.

2. The road milling machine of claim 1 wherein:

the ground surface may be a treated or an untreated ground surface.

3. The road milling machine of claim 1, wherein:

the at least one ground engaging sensor includes first and second ground engaging sensors displaced relative to each other in the direction of travel, the first and second ground engaging sensors generating first and second distance signals corresponding to a distance of the frame from the ground surface at the first and second ground engaging sensors, respectively; and the controller is configured to detect a longitudinal inclination of the frame in the direction of travel from the first and second distance signals.

4. The road milling machine of claim 3, wherein:

the first ground engaging sensor is configured to engage a treated portion of the ground surface; and the second ground engaging sensor is configured to engage an untreated portion of the ground surface.

5. The road milling machine of claim 4, wherein:

at least one of the first and second ground engaging sensors comprises one of the ground engaging supports.

6. The road milling machine of claim 3, wherein:

the first ground engaging sensor is configured to engage a treated portion of the ground surface; and the second ground engaging sensor comprises the stripping plate or at least one of the ground engaging supports engaging an treated portion of the ground surface.

7. The road milling machine of claim 3, further comprising:

a band shoe attached to the frame and adjustable in height relative to the frame; and a transport band connected to the band shoe.

8. The road milling machine of claim 7; wherein:

the first ground engaging sensor is configured to engage an untreated portion of the ground surface; and the second ground engaging sensor comprises the band shoe, or at least one of the ground engaging supports, or at least one of the side plates, engaging the untreated portion of the ground surface.

9. The road milling machine of claim 3, wherein:

each of the first and second ground engaging sensors comprises a path measurement system configured to generate the first and second distance signals.

10. The road milling machine of claim 9, wherein:

the path measurement systems are integrated in the lifting columns or in hydraulic cylinders of the lifting columns.

11. The road milling machine of claim 1, wherein:

the at least one ground engaging sensor comprises at least one of the side plates and further comprises a relative angle detector configured to detect a relative angle between the frame and the at least one side plate when the at least one side plate is resting on the ground surface.

12. The road milling machine of claim 1, wherein:

the ground engaging supports comprise track assemblies; and the at least one ground engaging sensor comprises at least one of the track assemblies and further comprises a relative angle detector configured to detect a relative angle between at least one of the lifting columns extending orthogonally to the frame and the track assembly associated with the at least one of the lifting columns when the track assembly engages and extends parallel to the ground surface.

13. The road milling machine of claim 1, wherein:

the controller is configured to establish the parallel orientation of the machine frame relative to the ground surface only when the controller performs a readjustment of the milling depth of the milling roller or a setting of a predefinable milling depth.

14. The road milling machine of claim 13, wherein:

the controller is configured to select which of the lifting columns are to have their lifting conditions controlled to control the milling depth of the milling roller.

15. The road milling machine of claim 1, wherein:

the controller is configured to detect and control a milling depth of the milling roller; and the controller is configured to control the parallel orientation of the machine frame independently of control of the milling depth of the milling roller.

16. The road milling machine of claim 1, wherein:

the controller is configured to detect and control a milling depth of the milling roller;

the machine frame has left and right sides, with reference to the direction of travel; and the controller is further configured to independently control the milling depth of the milling roller on each of both sides of the machine frame.

17. The road milling machine of claim 1, wherein:

the controller is configured to detect and control a milling depth of the milling roller;

the at least one ground engaging sensor includes a first ground engaging sensor configured to engage the ground surface, and a second ground engaging sensor configured to engage a bottom of a milling track formed by the milling roller; and the controller is further configured to determine the milling depth of the milling roller from signals received from the first and second ground engaging sensors.

18. The road milling machine of claim 17, wherein:

the second ground engaging sensor comprises the stripping plate.

19. The road milling machine of claim 17, wherein:

the first ground engaging sensor comprises at least one of the side plates, the at least one side plate being pivotably mounted relative to the machine frame.

20. The road milling machine of claim 17, wherein:

the controller is configured to detect displacement of the first ground engaging sensor relative to the second ground engaging sensor.

21. The road milling machine of claim 17, wherein:

the controller is configured to detect displacement of each of the first and second ground engaging sensors relative to the machine frame.

22. The road milling machine of claim 1, further comprising:

at least one hydraulic piston and cylinder unit arranged to lift and lower at least one of the side plates or the stripping plate, the hydraulic piston and cylinder unit including an integrated path sensing system.

23. The road milling machine of claim 22, wherein:

the at least one hydraulic piston and cylinder unit includes a first hydraulic piston and cylinder unit connected to one of the side plates, and a second hydraulic piston and cylinder unit connected to the stripping plate, and the integrated path sensing systems provide path sensing signals relative to the machine frame to the controller for computing a current milling depth.

24. The road milling machine of claim 1, wherein:

the side plates are pivotably connected to the machine frame, and each side plate includes first and second measuring devices spaced in the direction of travel and configured to detect a distance between the side plate and the machine frame; and the controller is configured to detect from the measuring devices the longitudinal inclination and a transverse inclination of the machine frame relative to the ground surface.

25. The road milling machine of claim 1, wherein:

at least one of the lifting columns includes a path sensing system configured to detect a lifting condition of the lifting column.

26. The road milling machine of claim 1, wherein:

each of the lifting columns includes a path sensing system configured to sense a lifting condition of the lifting column; and the controller is configured to control the lifting condition of all of the lifting columns so that the machine frame has a predetermined transverse inclination transverse to the direction of travel.

27. The road milling machine of claim 1, wherein:

the controller is configured to set a zero level of a measuring signal corresponding to a position of the at least one ground engaging sensor.

28. The road milling machine of claim 1, wherein:

the milling roller is supported in a height adjustable manner in the machine frame.

29. The road milling machine of claim 28, wherein:

the controller is configured to generate a control signal for the height adjustment of the milling roller.

30. The road milling machine of claim 1, wherein:

the controller is configured to control a lifting condition of the front and rear lifting columns so that for establishing the parallel orientation of the machine frame in the direction of travel, the machine frame is pivotable about an axis of rotation of the milling roller.

31. A method of milling a ground surface with a milling machine having a machine frame, a milling roller supported from the machine frame, front and rear ground engaging supports with reference to a direction of travel, and front and rear lifting columns supporting the machine frame from the ground engaging supports, the method comprising:

(a) detecting a longitudinal inclination of the machine frame relative to the ground surface in the direction of travel by detection of at least one measurement value from at least one ground engaging sensor; and (b) automatically controlling a lifting condition of at least one of the lifting columns so as to automatically establish a parallel orientation of the machine frame to the ground surface in the direction of travel, in dependence on the detected longitudinal inclination of the machine frame.

32. The method of claim 31, wherein:

step (b) is performed only in association with a readjustment of a milling depth of the milling roller, or a setting of a predetermined milling depth.

33. The method of claim 31, wherein:

step (b) further comprises automatically determining which of the lifting columns are to have their lifting conditions controlled in response to a change in the milling depth.

34. The method of claim 31, further comprising:

measuring a milling depth of the milling roller by detecting a first measurement value of a first ground engaging sensor configured to engage an untreated portion of the ground surface, and a second measurement value of a second ground engaging sensor configured to engage a bottom of a milling track formed by the milling roller.

35. The method of claim 34, further comprising:

automatically controlling the milling depth of the milling roller; and wherein in step (b) the controlling for establishing a parallel orientation of the machine frame is performed independently of the controlling of the milling depth.

36. The method of claim 31, further comprising:

automatically controlling a milling depth of the milling roller independently on each of both sides of the machine frame.

37. The method of claim 31, wherein:

step (b) further comprises controlling the lifting condition of the at least one of the lifting columns such that the machine frame is pivoted about a rotational axis of the milling roller.

38. A self-propelling road milling machine, comprising:

a machine frame;

at least two front ground engaging supports, and at least one rear ground engaging support, with reference to a direction of travel;

front and rear lifting columns supporting the frame from the ground engaging supports;

a milling roller supported from the frame for treatment of a ground surface;

first and second height adjustable side plates arranged on opposite sides of the milling roller;

a height adjustable stripping plate arranged behind the milling roller and operable to be lowered, during operation, into a milling track generated by the milling roller;

at least one sensor located laterally within a width of the machine defined by the side plates; and a controller operably associated with the at least one sensor, the controller being configured to automatically control a lifting condition of at least one of the lifting columns to establish a parallel orientation of the machine frame relative to the ground surface in the direction of travel.

39. The machine of claim 38, wherein:

the sensor is a ground engaging sensor.

40. The machine of claim 38, wherein:

the machine further comprises a band shoe attached to the frame and adjustable in height relative to the frame; and the sensor comprises at least one ground engaging component of the machine selected from the group consisting of the at least one of the ground engaging supports, at least one of the side plates, the stripping plate and the band shoe.

* * * * *

UNITED STATES PATENT AND TRADEMARK OFFICE

CERTIFICATE OF CORRECTION

PATENT NO. : 8,424,972 B2
APPLICATION NO. : 12/226342
DATED : April 23, 2013
INVENTOR(S) : Berning et al.

It is certified that error appears in the above-identified patent and that said Letters Patent is hereby corrected as shown below:

In the Claims:

Column 12, line 45, Claim 6, replace “an” with --a--.

Signed and Sealed this
Third Day of September, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,424,972 B2
APPLICATION NO. : 12/226342
DATED : April 23, 2013
INVENTOR(S) : Berning et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 636 days.

Signed and Sealed this
Eighth Day of September, 2015

Michelle K. Lee

Michelle K. Lee
*Director of the United States Patent and Trademark Office*